US005162003A

United States Patent [19]

Johnson et al.

[11] Patent Number: 5,162,003

[45] Date of Patent: Nov. 10, 1992

[54] ELECTRICAL CONNECTOR WITH A CONSTANT RADIUS OF CURVATURE BEAM

[75] Inventors: Richard A. Johnson, Poughkeepsie, N.Y.; Daniel G. Landry, Sacramento, Calif.; Howell B. Schwartz, Poughkeepsie, N.Y.

[73] Assignee: International Business Machines Corporation, Armonk, N.Y.

[21] Appl. No.: 744,033

[22] Filed: Aug. 12, 1991

[51] Int. Cl.[5] ..... H01R 13/11

[52] U.S. Cl. ..... 439/842; 439/856

[58] Field of Search ..... 439/842-857, 439/861, 862

[56] References Cited

U.S. PATENT DOCUMENTS

| | | | |
|---|---|---|---|
| 2,486,285 | 10/1949 | Hurst | 439/843 |
| 3,274,532 | 9/1966 | Engel | 439/741 |
| 3,289,148 | 11/1966 | Antes | 439/741 |
| 4,152,042 | 5/1979 | Ostapovich | 439/852 |
| 4,566,752 | 1/1986 | Hemmer | 439/851 |
| 4,591,230 | 5/1986 | Roldan . | |
| 4,634,210 | 1/1987 | Crawford | 439/856 |

*Primary Examiner*—David L. Pirlot
*Attorney, Agent, or Firm*—Whitham & Marhoefer

[57] ABSTRACT

A female contact for an electrical connector in which the contact comprises a resilient, conductive beam with a curve of constant radius. One end of the beam bears against a flat wall section of a bore into which a male contact pin is inserted to make contact. The strip curves away from the wall, and as the pin is inserted it flattens the strip against the wall.

4 Claims, 4 Drawing Sheets

ELECTRICAL CONNECTOR WITH A CONSTANT RADIUS OF CURVATURE BEAM

BACKGROUND OF THE INVENTION

1. Field of the Invention

This invention relates to an improved female electrical contact, more particularly a contact suited for use in high-density contact arrays.

2. Description of the Prior Art

Typical prior art female electrical contacts have beam-like sections or arms that are deflected when the male contact member is inserted. FIG. 1 shows such a typical female contact. Deflection of the contact arms 10 generates a bending stress in the arms, and the reaction to this bending stress is a force "F" normal to the connector axis 12 that urges the arms against the inserted male contact member 14, making the electrical connection. As illustrated, the bending stress, and hence the normal force in such prior art female contacts, varies as a function of the lateral displacement of the arms from an unstressed position. While generally satisfactory, a change in dimensions in either the male or female member from its nominal value causes a change in stress and in normal force. On the scale of subminiature contacts, changes from a nominal value in male or female contact dimensions, or geometry, or in the position of a given contact in an array of many contacts, even changes within allowable manufacturing tolerances, can cause significant changes in stress and normal contact force "F".

Prior art female contacts are therefore not uniformly stressed, experience high local stresses, and may not in all cases provide sufficient contact force.

SUMMARY OF THE INVENTION

An object of the invention is the provision of a redundant female contact in which the stress in the contact member and the normal force applied by the contact member to the male member are relatively independent of changes in the dimensions or geometry of the male or female contact.

Briefly, this invention contemplates the provision of a female contact for an electrical connector in which the contact comprises a resilient, conductive beam with a constant radius of curvature. One end of the beam bears against a flat wall section of a bore into which a male contact pin is inserted in making contact. The beam is orientated so that its free end curves away from the wall and, as the pin is inserted, it flattens the beam against the wall.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
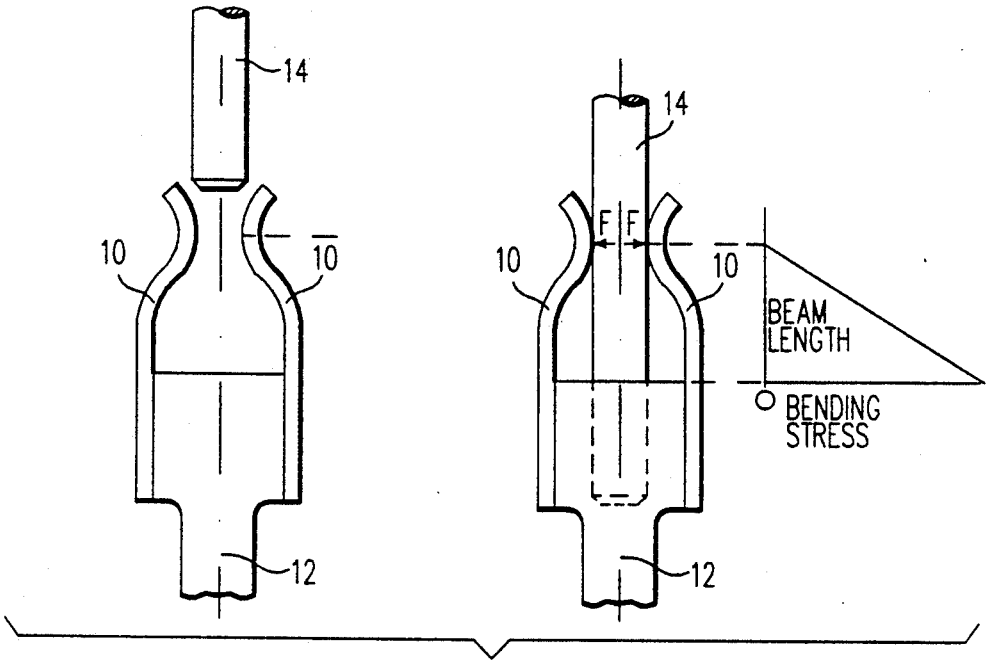
FIGS. 1 is a view of a typical prior art contact.
Figure 3B:
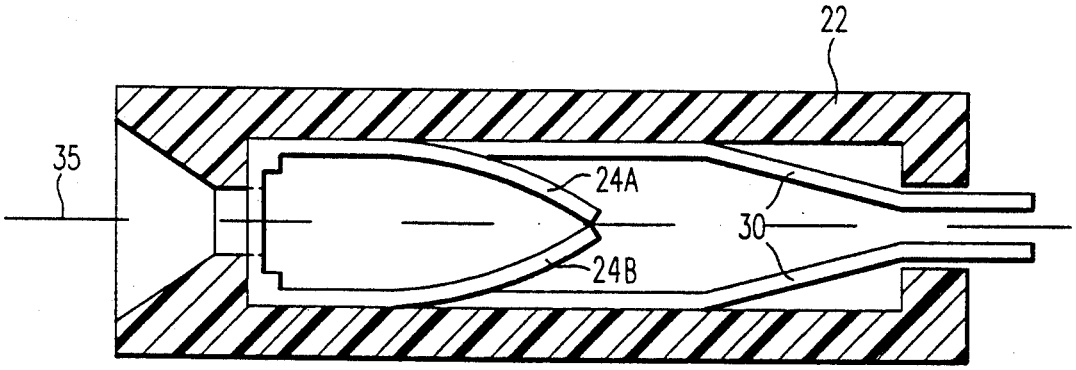
FIG. 3B is a sectional view similar to FIG. 3A showing additional detail and also rotated ninety degrees with respect to FIG. 3A.
Figure 3A:
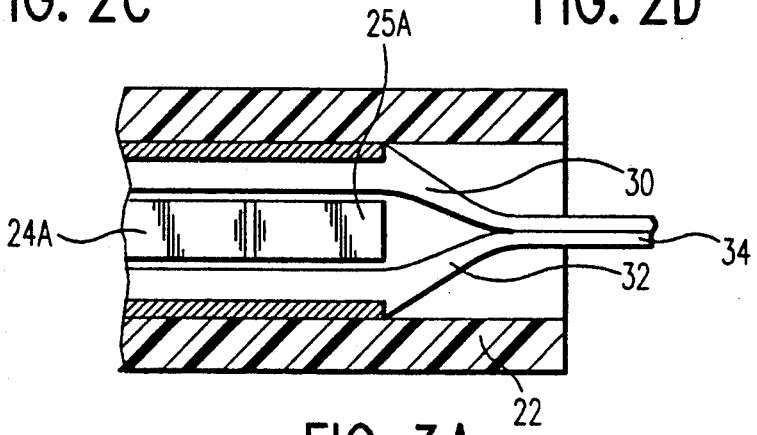
FIG. 3A is a fragmentary sectional view of the connector shown in FIG. 2 illustrating additional details of the connector structure.

Referring now to FIGS. 2 and 3 of the drawings, a female contact in accordance with the teachings of this invention has a cylindrical plastic housing 22 with a bore extending along axis 35 defining an interior wall surface. A pair of conductive strips or beams 24A and 24B are disposed in the bore along axis 35. The conductive beams are made of a suitable conductive resilient material such as beryllium copper. In this preferred embodiment of the invention beams 24A and 24B are formed integrally with contact stems 30 and 32. The contact stems 30 and 32 are mechanically secured to the housing 22 by a suitable means and extend along the housing 22 so that, if desired, they can serve to edge guide the beams 24A and 24B in a direction perpendicular to the direction of intended beam motion during insertion and withdrawal of a male pin contact member. The contact stems 30 and 32 extend out of the housing 22 and are joined to form a connection pin or tail 34 to which an external electrical connection can be made.

The beams 24A and 24B are formed so that their free ends 25A and 25B curve inwardly, away from flat interior wall sections 26A and 26B in the housing 12. As will be further explained in connection with FIGS. 4 and 5, the inward curve of each beam 24A and 24B has a constant radius, and insertion of a male connector pin 28 into the connector progressively flattens a portion of each beam against corresponding flat portion 26A or 26B of the housing wall as it moves along the axis of the connector.

Figure 4:
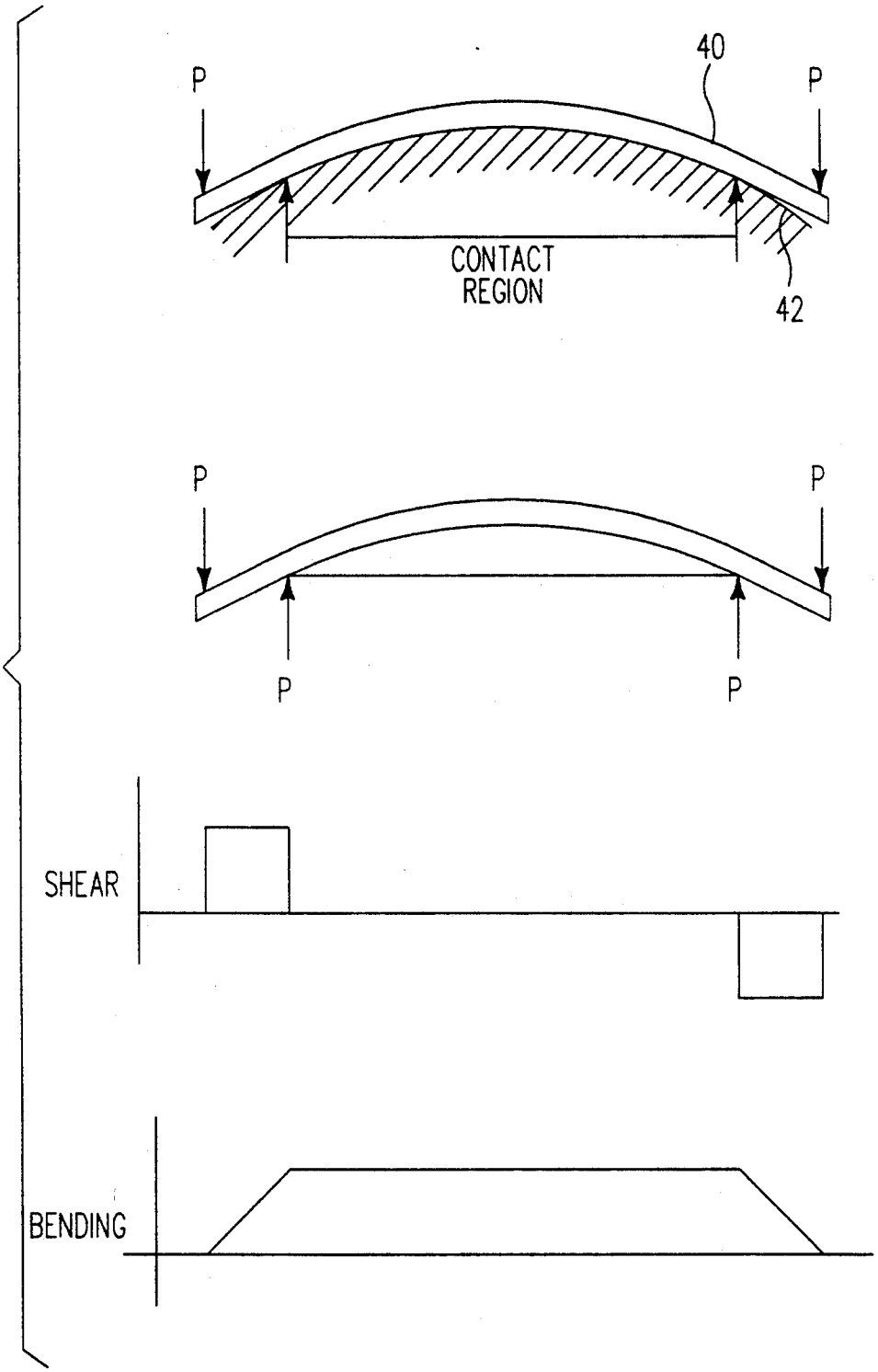
FIG. 4 illustrates the Force Distribution, Shear, and Bending Moment for a beam in contact with a mandrel of constant radius.
Figure 5:
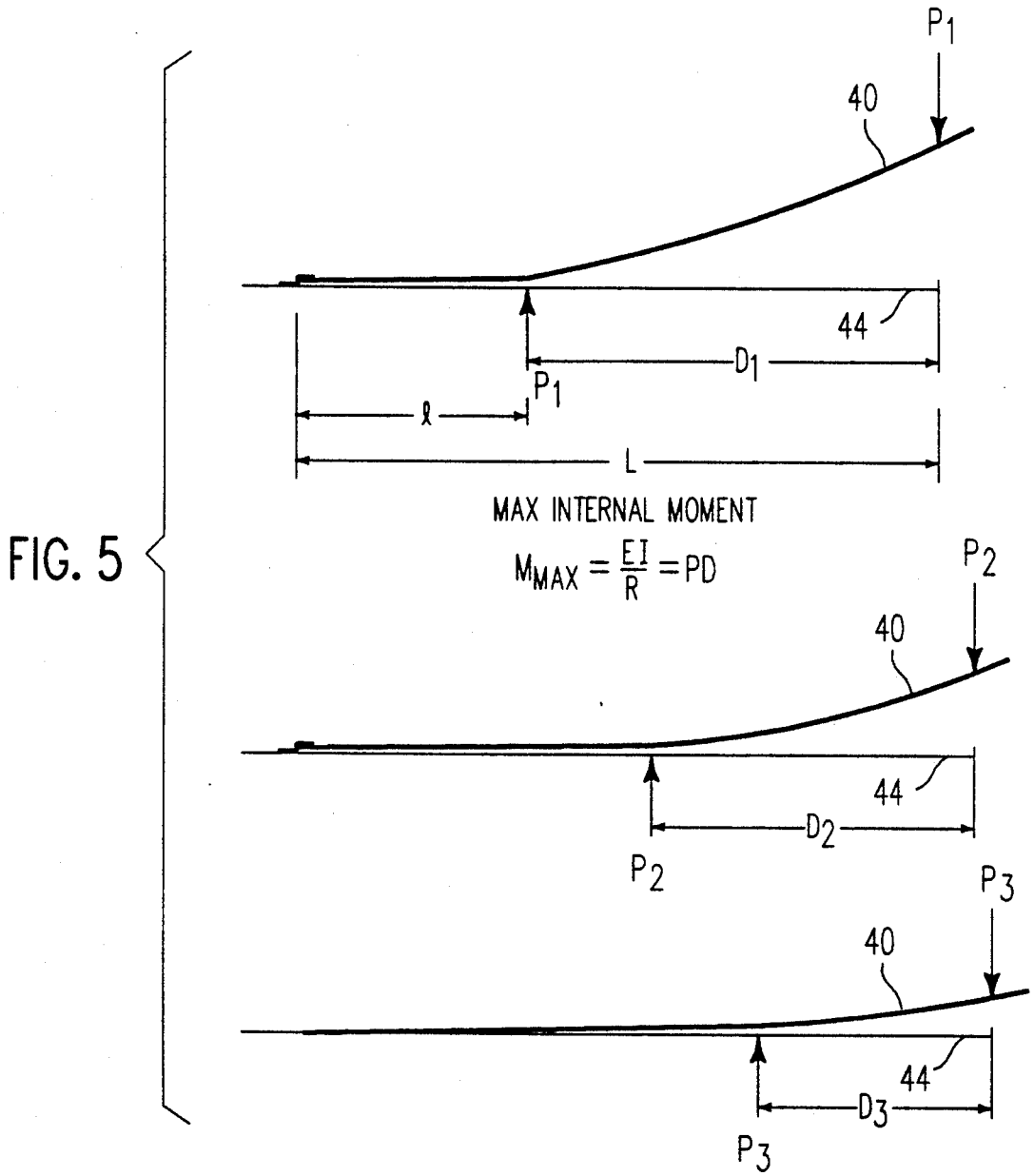
FIG. 5 illustrates the maximum internal bending moment for a beam of constant radius of curvature as the beam is flattened.
Figure 6:
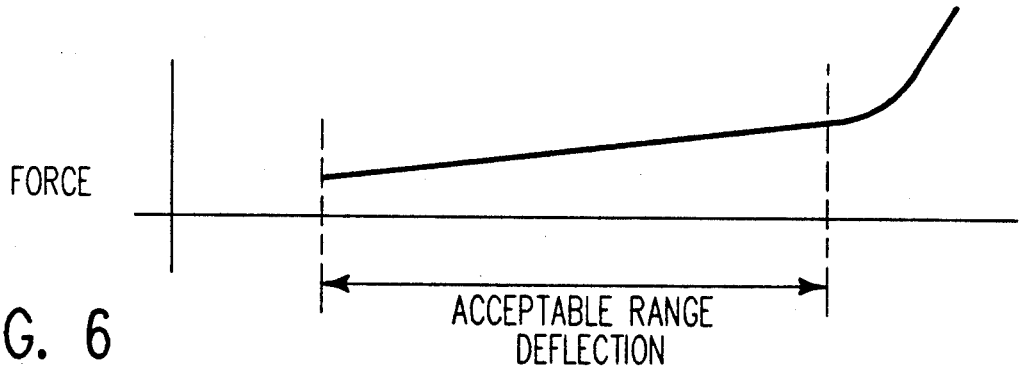
FIG. 6 is a graph showing the typical relationship between normal contact force and contact deflection for a contact in accordance with the teachings of this invention.

Referring now to FIG. 4, as will be appreciated by those skilled in the art, a flat strip or beam 40 bent about a mandrel 42 of constant radius experiences in response to a force "P" a constant bending stress and a constant bending moment at any contact point along the mandrel. As illustrated in FIG. 5, if a curved strip or beam 40 with a constant radius of curvature, (i.e., contact beams 24A and 24B) is forced to flatten out against a flat support 44, the beam will experience a predetermined maximum bending stress:

$$M_{MAX} = \frac{EI}{R} = PD$$

throughout the original curved region irrespective of the length of this curved section D. Thus it will be appreciated that the stress and bending moment are substantially independent of contact beam dimensions and male pin connector dimensions within a reasonable range of manufacturing tolerances. FIG. 6 shows a typical curve of normal contact force vs. contact displacement for a contact in accordance with the teaching of this invention. It should be noted the radius of curvature could vary in a predetermined manner in an alternate embodiment of the invention. For example, the radius could vary as a function of the length along the beam member. In such a case, as the beam is flattened, the force versus deflection behavior would change somewhat from that shown in FIGS. 4, 5 and 6.

Figure 7:
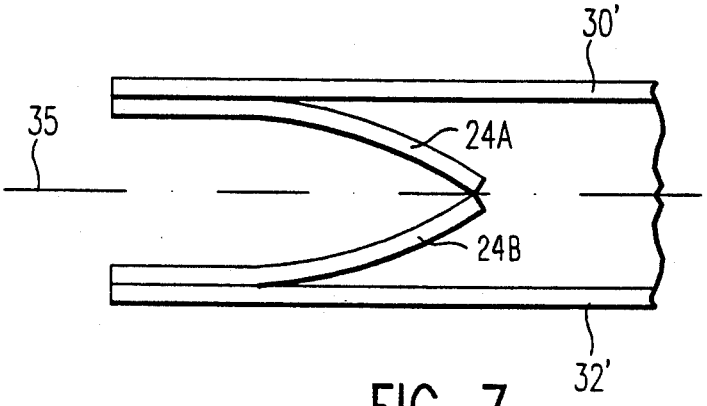
FIG. 7 is a partial sectional view of an alternative embodiment of the invention.
Figure 2A:
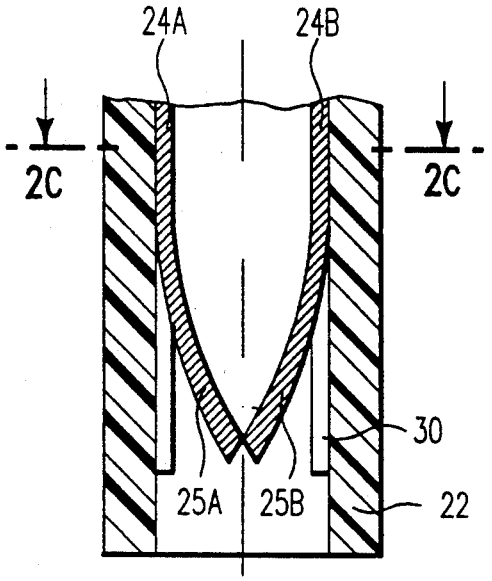
FIG. 2A is a fragmentary, sectional view of one embodiment of a connector in accordance with the teachings of this invention.
Figure 2B:
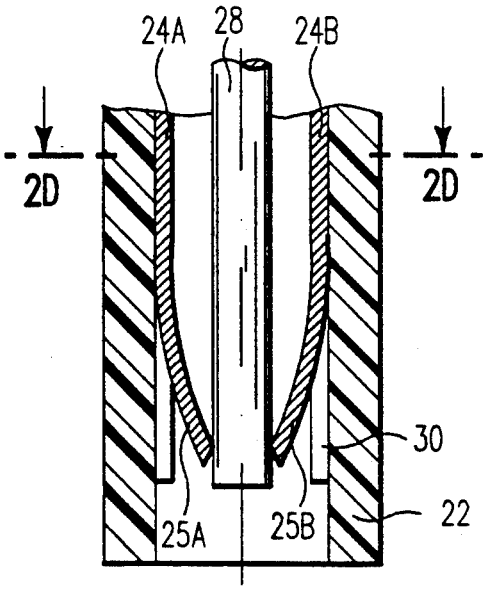
FIG. 2B is a similar view with a male connector pin inserted into the connector.
Figure 2C:
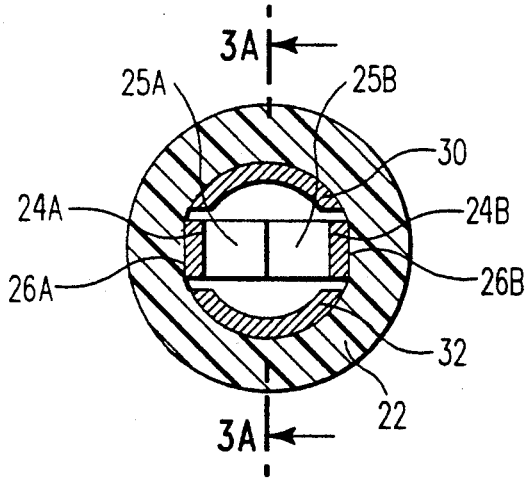
FIGS. 2C and 2D are sectional views along the lines C—C and D—D in FIGS. 2A and 2B respectively.
Figure 2D:
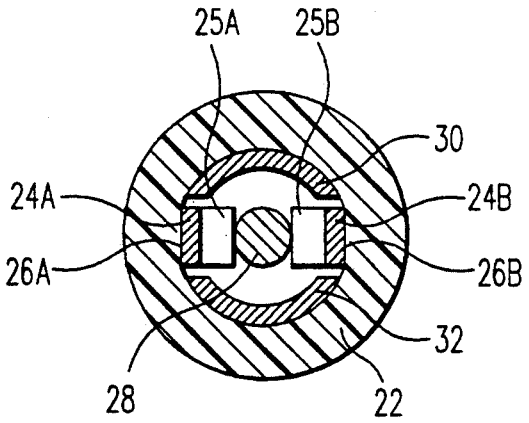

FIG. 7 shows an alternate embodiment of the invention in which contact stems 30' and 32' are orientated so that they form interior wall sections along axis 35 and the conductive beam members 24A and 24B flatten against the conductive stems.

While the above specific embodiment of the invention has a mating pair of redundant contacts, it will be appreciated that other configurations are possible. For example, a number of contact beams "n" arranged at (360/n) degrees apart. The n=2 case, for double redundancy, is illustrated in this specific embodiment of the invention.

While the invention has been described in terms of a single preferred embodiment, those skilled in the art will recognize that the invention can be practiced with modification within the spirit and scope of the appended claims.

Having thus described out invention, what we claim as new and desire to secure by Letters Patent is as follows:

1. An electrical connector for receiving a male connector, comprising in combination:

an electrically insulating housing having an interior wall surface;

an electrically conducting female connector assembly disposed in and secure to said electrically insulating housing;

said female connector assembly including a conductive beam member disposed so that a region at one end of said beam member contacts said interior wall surface;

said conductive beam extending from said one end in an arc away from said interior wall surface so that said conductive beam member becomes progressively flattened against said interior wall surface as a male connector moves into said insulating housing in contact with said conductive beam member.

2. An electrical connector as in claim 1, wherein said female connector assembly includes a conductive contact stem, said stem extending along said interior wall surface and forming a guide to retard lateral displacement of said conductive beam as it flattens against said interior wall surface.

3. An electrical connector as in claim 2, wherein said arc has a constant radius of curvature.

4. An electrical connector as in claim 3, wherein said arc has a varying radius of curvature, said radius of curvature varying as a function of the distance from said one end along the length of said conductor beam for changing normal contact force versus contact displacement characteristics of said conductive beam as it is progressively flattened against said interior wall.

* * * * *